US005370313A

United States Patent [19]

Beard

[11] Patent Number: 5,370,313

[45] Date of Patent: Dec. 6, 1994

[54] STERILE LIQUID DISPENSER

[76] Inventor: Walter C. Beard, South St., P.O. Box 340, Middlebury, Conn. 06762

[21] Appl. No.: 179,385

[22] Filed: Jan. 10, 1994

[51] Int. Cl.[5] ..... B05B 7/32; B67D 3/00

[52] U.S. Cl. ..... 239/337; 222/402.15; 222/509; 222/514; 239/488

[58] Field of Search ..... 222/513, 514, 512, 505, 222/509, 518, 522–525, 402.12, 402.15; 239/487, 488, 491, 337

[56] References Cited

U.S. PATENT DOCUMENTS

| | | | |
|---|---|---|---|
| 2,253,738 | 8/1941 | Totsching | 222/514 |
| 2,974,835 | 3/1961 | Herbrick | 222/513 X |
| 3,361,301 | 1/1968 | Meshberg | 222/402.12 X |
| 3,504,893 | 4/1970 | Susuki et al. | 239/488 |
| 3,549,060 | 12/1970 | Smylie | 222/513 |
| 3,608,784 | 9/1971 | Brown et al. | 222/509 X |
| 3,712,517 | 1/1973 | Davenport | 222/509 X |
| 3,902,815 | 9/1975 | Williams | 222/518 X |
| 4,179,052 | 12/1979 | Abbott | 222/509 |
| 4,477,001 | 10/1984 | Galia | 222/514 X |
| 4,752,020 | 6/1988 | Grueter et al. | 222/505 X |
| 4,826,054 | 5/1989 | Frutin | 222/509 X |

FOREIGN PATENT DOCUMENTS

| | | | |
|---|---|---|---|
| 209483 | 4/1940 | Switzerland | 222/524 |

*Primary Examiner*—Kevin P. Shaver
*Attorney, Agent, or Firm*—Dallett Hoopes

[57] ABSTRACT

A hollow body has a connected tubular discharge stem. The stem has a tapered tip formed with at least one discharge passage. An annular gasket complementing the shape of the taper is normally seated on the tip and valves off the passage. A hollow tubular shell is over the stem and carries the gasket at its upper end. The shell encloses a spring working between the bottom of the shell and a fin on the stem spaced back from the tip. In operation, the shell is moved away from the body so liquid can discharge through the gasket.

9 Claims, 2 Drawing Sheets

STERILE LIQUID DISPENSER

BACKGROUND OF THE INVENTION

1. Field of the Invention

This invention relates to dispensers especially adapted for dispensing sterile liquids, for instance, liquids which may be used in eye care.

Usually, dispensing containers for eye treatment solutions are yieldable plastic containers, commonly known as squeeze bottles. Such containers are in common use for eye drops to treat dryness, reddening, allergic responses and general eye discomfort as well as for drops or streams of liquids used with contact lenses for the eyes.

When a drop, stream or spray of treatment solution from such a container is dispensed and the squeezing pressure is released, external air and contaminates are drawn back into the container where bacterial growth can take place. It is well known that the treatment solutions themselves may serve as a nutrient medium for bacterial growth.

It has, therefore, been necessary to lace the treatment solution with preservatives. Typical preservative materials include a mercurial compound such as sodium merthiolate (also known as thimerosal); benzalkonium chloride; disodium edetate; sorbic acid; chlorhexidine gluconate; polyaminopropyl biguanide; ethylene diamine tetramine; and sodium sorbate. Because of the irritating nature of some preservatives, there has been a reaction on sensitive tissues on some subjects, a decidedly unacceptable consequence.

There has been a need, therefore, for a dispenser adapted to prevent the build-up and migration of bacteria between the discharge opening and the contents of the container. The present invention provides this by means of a tip-sealing valve for use with a pressurized container.

2. Description of Related Art Including Information Disclosed under §§1.97 to 1.99

The structures of valves in the prior art do not present characteristics which would make them suitable in the present instance. Typical aerosol valves such as Abplanalp U.S. Pat. No. 2,631,814 and Lapin U.S. Pat. No. 2,704,172 have a passageway between the discharge orifice and the actual valve seat or shutoff point. Such a passageway is known to be a site for accumulation and storage of discharge product, a place where bacteria can breed and grow. No valve in the prior art appears especially designed to fulfil the present need.

Structurally, earlier patents of interest include my own U.S. Pat. No. 3,506,165 issued Apr. 14, 1970. This valve is adapted to dispense glue or other sticky or tacky materials which would tend to clog the outlet orifice. It is also useful in the dispensing of other products, such as whipped cream or toothpaste, wherein it is important that the product not be permitted to accumulate between the valve and the end of the orifice.

My U.S. Pat. No. 3,506,165 disclosed as its nozzle a tipable outer shell having an orifice centrally disposed in its end and enclosing a plug extending upwardly toward the orifice. The plug has a flange on its inner end so that when the outer shell is tipped, the plug is drawn downwardly away from the orifice and permits material to discharge. While the invention of my earlier patent is meritorious, its structure involved the mounting of the shell so as to be tipable requiring a substantial amount of actuating force. This type of actuation is awkward when in application of solutions to the eye.

Another patent of interest not relating to an aerosol valve, is U.S. Pat. No. 4,807,786 to Gueret issued Feb. 28, 1989. In this patent there is disclosed a container presumably a squeeze bottle for a lotion. The container has a fixed cover plate formed with an upward bulb apertured adjacent its tip and the container receives a reciprocable cap formed with a central apertured recess which fits over the bulb. The cap may be raised or lowered to permit contents of the container to discharge out the orifices. Special cam means are provided so that the cap can be raised with one hand.

In the Newby U.S. Pat. No. 2,969,168 issued Jan. 24, 1961 a fixed solid post is surrounded by a movable member having an axial post-receiving cavity with a small orifice at its upper end. When the movable member is down, the post plugs the opening, and when the movable member is raised, the post clears the opening to permit discharge.

The Hammerstein U.S. Pat. No. 1,707,660 issued Apr. 2, 1929 has a peaked cover plate with orifices on either side of the plate and a reciprocable tubular plunger, the lower end of which closes off the orifices. The plunger may be raised to clear the orifices and permit discharge flow.

The LoTurco U.S. Pat. No. 4,739,906 issued Apr. 26, 1988 discloses a squeeze bottle having a fixed upward stem with apertures in its base and a flexible conical nozzle which seals and overlies it. When the container is squeezed, product passes through the apertures causing the conical nozzle to bulge out, breaking the seal and discharging out the nozzle.

My earlier U.S. Pat. No. 3,254,676 issued Jun. 7, 1966 discloses a tilt valve wherein the stem has a head with pivotable side arms and a central valving surface so that an arm may be tilted to move the surface past the outlet and actuate the valve at the same time.

Levers and toggles have been used in the past to operate valves and are disclosed, for instance, in U.S. Pat. Nos. 1,557,127 to Wilkin and 523,254 to Winkley.

SUMMARY OF THE INVENTION

The invention, therefore, is a dispenser for sterile liquid comprising a hollow body adapted to contain the liquid and a tubular discharge stem connected to the body and having a distal end portion formed with at least one discharge passage therein. An annular gasket complementing the shape of the end portion is normally seated on the end portion and shuts off the passage. Means including a hollow tubular shell with the gasket secured in one end and surrounding the stem are provided for moving the gasket in a direction axially away from the end portion to permit discharge through the center of the gasket. In the preferred version the shell encloses a spring working between the bottom of the shell and a fin on the stem spaced back from the end portion. A lever or other means may be provided so that the operator can conveniently move the shell away from the hollow body to unseat the gasket and permit discharge.

BRIEF DESCRIPTION OF THE DRAWINGS

Further objects and features of the invention will be apparent to those skilled in the art from a reading of the following specification and reference to the drawings, all of which disclose a non-limiting embodiment of the invention. In the drawings.

DESCRIPTION OF THE PREFERRED EMBODIMENT

Figure 1:
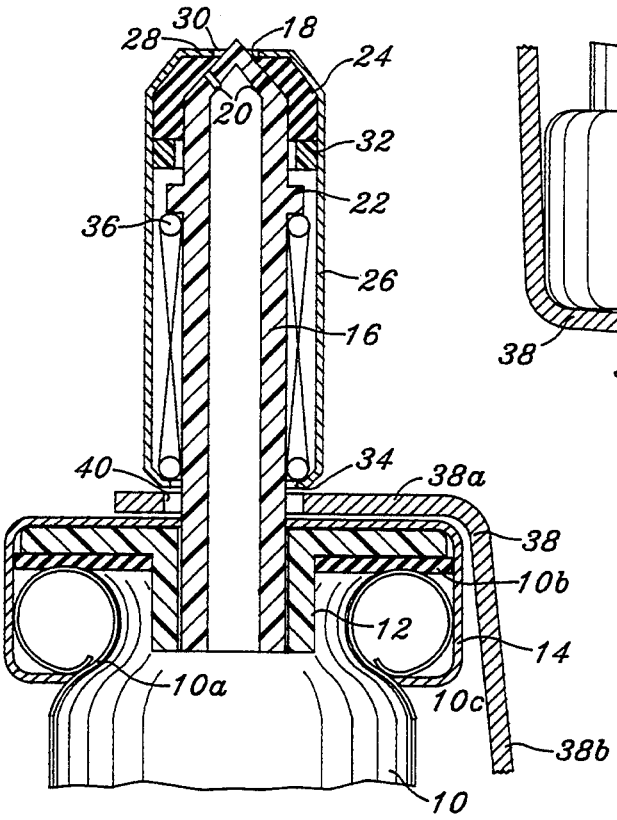
FIG. 1 is a fragmentary view in section, of a dispensing container embodying the invention.

An embodiment of the invention is shown in FIG. 1. It comprises a bottle 10 (shown only in part for economy of drawing space). The bottle may be metal, as shown, plastic or glass. The neck of the bottle is formed with an outward curl 10*a* which supports an annular sealing member 10*b* in turn supported by a spool 12 which is defined by a tubular spud having at its upper end an outward flange. The sealing member 10*b* and flange of the body 12 are clamped onto the curl 10*a* by the usual ferrule 14.

As shown, the stem 16 is tubular and is formed at its remote delivery end with a tapered tip 18 terminating in a point. The lower end of the stem 16 is sealingly received into the tubular central portion of the spool 12 by which it is firmly supported. To assure a leak-proof connection, the juncture between the stem and spool may be welded or otherwise sealed at the lower end. The tapered tip is formed with at least one orifice 20 to communicate the axial passage of the stem 16 to the outside. Spaced back from the tip the stem is formed with an outward annular rib 22. As shown, the stem 16 may be molded from plastic, such as nylon or polypropylene, or may be turned or otherwise shaped from a metal such as aluminum or stainless steel.

An annular bacteria-displacing gasket or seat 24 having an internal surface complementing the shape of the tip 18 is provided. The gasket 24 may be of rubber or a resilient plastic, such as the thermoplastic rubber Santoprene 281-55 manufactured by the Monsanto Company. It is shaped so that when seated, it fits snugly against the tapered tip of the stem, closing off the orifice 20 to prevent discharge. The angled inner surface of the gasket 24 is such that when it is seated, all liquid between the gasket and the tip is expelled outward through the opening in the annular gasket adjacent the tip of the stem.

The gasket 24 is secured at the upper end of a shell 26 which may be of metal such as aluminum or stainless steel, or plastic and includes a shape at the upper end including a first inward flange 28 which conforms to the shape of the gasket 24. A discharge opening 30 is provided through which the discharge of the system is made. To hold the gasket snugly in position against the upper end of the shell, a retaining ring 32 is wedged upwardly to abut the bottom of the gasket.

The lower end of the shell 26 is formed with a second inward annular flange 34. A compression spring 36 is provided and surrounds the stem 16 within the shell 26. It works between the fin 22 and the second annular inward flange 34 and serves so urge the shell downwardly toward the body 12 so that the gasket 24 seats on the tip 18. The second annular inward flange may be formed in the shell after the shell is in place on the stem.

Figure 2:
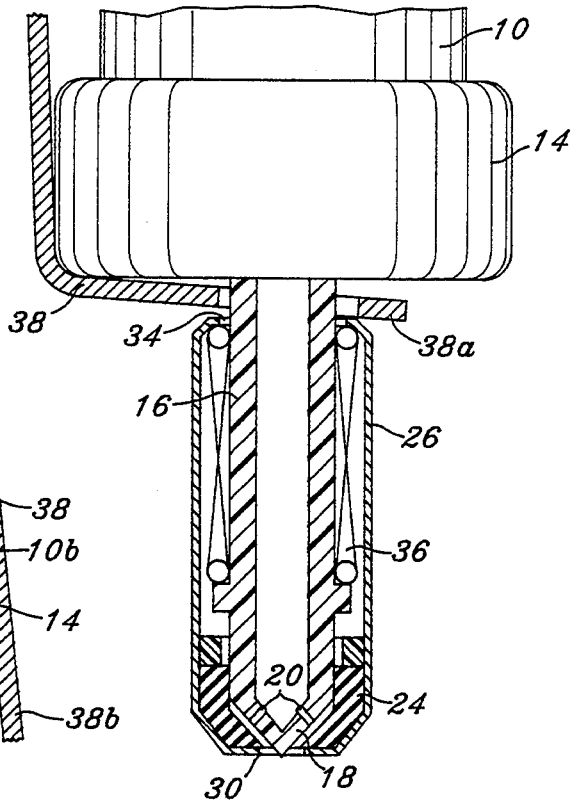
FIG. 2 is a view similar to FIG. 1 showing the container in dispensing attitude.

As means for moving the gasket 24 away from the tip 18 in a direction axial of the stem, the shell 26 and its various parts are supplemented by a lever 38 of L-shape. The short leg of the "L" 38*a* has an opening 40 which receives the stem between the body 12 and the bottom of the shell 26. The longer leg 38*b* of the L-shape lever 38 rides along the body 12 so that it may, with thumb and forefinger, be squeezed against the body 12 to operate the valve (FIG. 2). The lever fulcrums on the edge of enlargement 14.

FIG. 2 shows the lever 38 in operating disposition with the container upside down it usual use position. It will be seen that the shell 26 has been drawn away from the body 12 so that the gasket 24 at the end of the shell is unseated from the tip 18 of stem 16 against the force of the spring 36. This opens the orifices 20 for passage of sterile liquid from the body 12 out along the tip through the opening in the gasket 24 and the discharge opening 30 of the system. Discharge may be terminated by releasing the grip on the handle 38 so that the spring 36 drives the shell 26 toward the body 12 seating the gasket 24 on the tip 18.

Figure 3A:
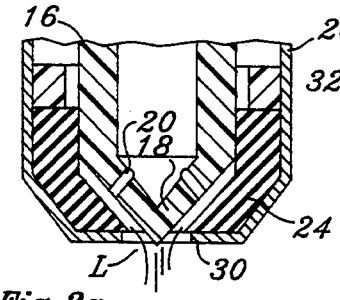
FIG. 3*a* is an enlarged fragmentary view showing the tip of the dispensing container with the gasket unseated as in dispensing.
Figure 3B:
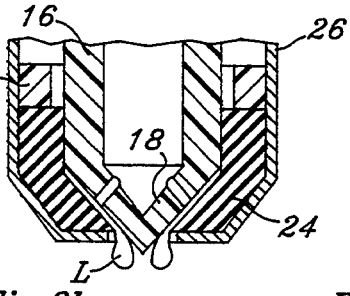
FIG. 3*b* shows the structure of FIG. 3*a* with the gasket closing.
Figure 3C:
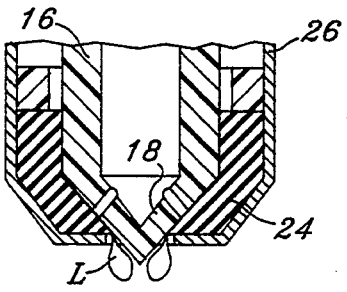
FIG. 3*c* shows the structure of FIGS. 3*a* and 3*b* during the final closing of the gasket on the tip finally separating off any residual sterile liquid.

FIGS. 3*a*, 3*b* and 3*c* show the gasket 24 in closing. In FIG. 3*a*, with the valve in the position shown in FIG. 2, there is flow out the orifices 20 through the hole in the gasket 24 and out the discharge opening 30. In FIG. 3*b*, with the lever 38 being released, the space between the gasket 24 and the tip 18 is being reduced so that liquid L is in the process of being expelled out of the space between the gasket 24 and the tip 18. Finally, in FIG. 3*c*, with the gasket 24 snugly seated against the tip 18, the last little bit of liquid L is forced out of the space and the final droplet of the sterile liquid L passes down through the opening in the gasket 24 and the discharge opening 30 for the system. With the displacement of the liquid L there is also displaced space wherein bacteria can reside and breed. Hence, the gasket is indeed "bacterial displacing". The tight seal squeezes away liquid in such a way as to provide no path for bacteria.

As a result of this structure, there is no residue of liquid between the discharge opening 30 for the system and the actual valve 18, 24. (The gasket 24 and the tip 18 may be thought of as a "valve".) Thus, there is no chance for the incubation of bacteria in this area. Further, because the gasket 24 presses snugly against the tip 18 between the orifice 20 and the inner end of the gasket 24, there is no chance of migration of bacteria to contaminate the contents of the stem and body 12.

It will be clear that the gasket 24, when seated, shuts off flow in either the direction of the extreme tip of the stem or in the direction toward the bottle. Because of this, there is no need to sealingly connect the shell to the stem at points remote from the tip portion. In other words, because the gasket 24 shuts the flow through passage 20 absolutely and not just above the passage 20 (FIG. 1), there is no need to seal the shell 26 to the stem 16 below the passage 20 (again referring to FIG. 1).

Figure 4A:
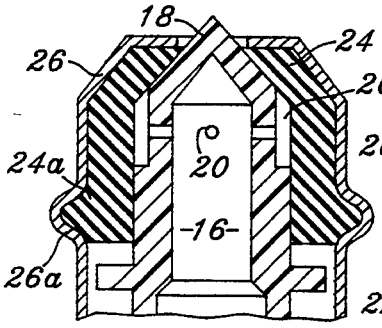
FIGS. 4*a*, 4*b*, 4*c* are variations on the shapes of the end portion of the stem, the gasket and the adjacent portion of the shell. They are sectional views comparable but enlarged from the upper end of FIG. 1.

FIG. 4*a* discloses a variation on the securement of the gasket 24 wherein a portion 24*a* has an outward annular projection. This fits into an annular recess in the wall of the shell 26 formed by outward shaping of the wall as at 26*a*. By this means there is no need for a retaining ring 32 of FIG. 1. This assures that the gasket 24 nestles snugly against the upper end of the shell 26. The gasket may be installed in the shell as the projection 24*a* "snaps" into the recess in a snap fit.

The stem 16 in FIG. 4*a* is formed with radial recesses 26*a* or notches in its periphery spaced down from the tapered portion. These recesses 20*a* comprise with the holes 20 passages which together are appropriately shut off as the gasket 24 seats. The FIG. 4*a* version of the stem is an example of a product which may be readily molded. Other manners of molding the stem to accomplish the same purpose will be apparent to those skilled in the art.

Figure 4B:
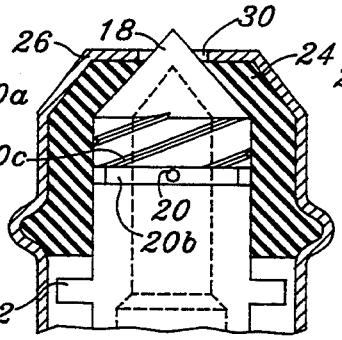

FIG. 4*b* incorporates the same method of securement of the gasket as FIG. 4*a*. Additionally, the through passage 20 of the stem meets the peripheral recess 20*b*. The latter communicates with a circumferential helical channel 20*c* in the stem which extends upward as shown in FIG. 4*b* to emerge in a juncture with the tapered tip 18. Channel 20*c* may be thought of as an extension of the passage 20 and 20*b*, the channel part of the passage being shut off when the gasket 24 seats. By virtue of this structure, when the gasket is unseated, the flowing liquid emerges from the channel into the space between the gasket and the tip 18. The nature of this space creates a swirl in the liquid which accelerates under the law of conservation of energy as the diameter of the swirl chamber decreases toward the opening 30. This is a effective breakup means for the liquid emerging from the dispenser as in the form of a spray.

Figure 4C:
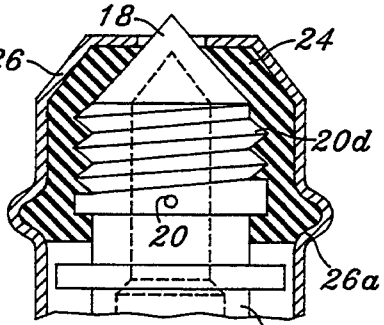

FIG. 4*c* is comparable to the version of FIG. 4*b* except that the helical part of the passage is in the form of a helical thread on the gasket 24 rather than on the stem. The helical channel may be readily molded on a solid molding core for the gasket 24 and may be easily stripped therefrom thanks to the resilience of the gasket material. The benefits of the 4*c* version are comparable to FIG. 4*b* especially when a fine spray is desired.

DESCRIPTION OF MODIFICATION

Figure 5:
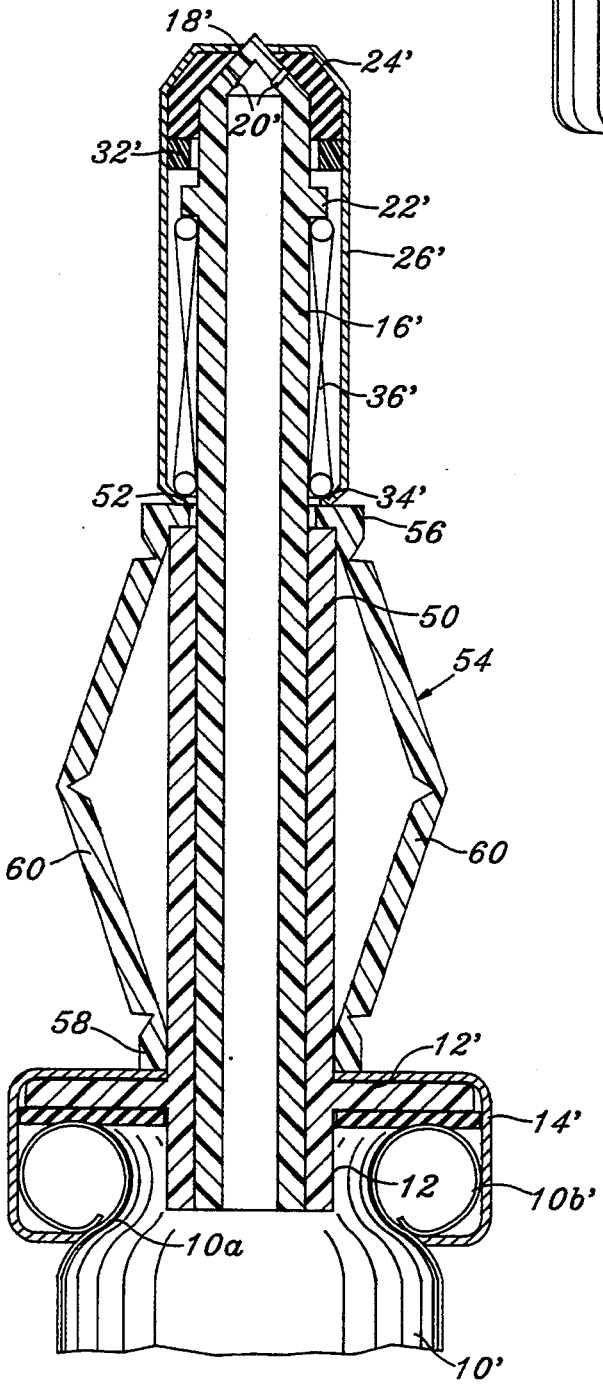
FIG. 5 is a view comparable to FIG. 1 but showing a modified form of the means for moving the gasket.

FIG. 5, which bears the primed forms of the same reference numerals as used in the earlier figures to denote similar parts, is a modification focused on a different way of moving the gasket 24' away from the tip 18'. In this version the stem 16' is formed with the orifices 20' in the tapered tip and the shell 26' carries the gasket 24' at its upper end. The spring 36', being disposed between the fin 22' and the second inward annular flange 34', urges the shell 26' downward.

In this modification the stem 16' is elongated and provided in a lower section (FIG. 4) with a shell supporting tube 50, an upward extension of the spool 12'. A toggle cage 54 is provided and comprises annular upper and lower elements 56, 58 respectively slideably disposed on the spool. These annular elements are integrally molded with bars 60 preferably uniformly spaced about the cage in even numbers, 2 or 4, for instance. The cage bars bow outwardly as shown and are each actually centrally articulated rigid straight sections connected by a "living hinge". In like fashion, the bars themselves are connected integrally to the annular elements 56, 58.

Figure 6:
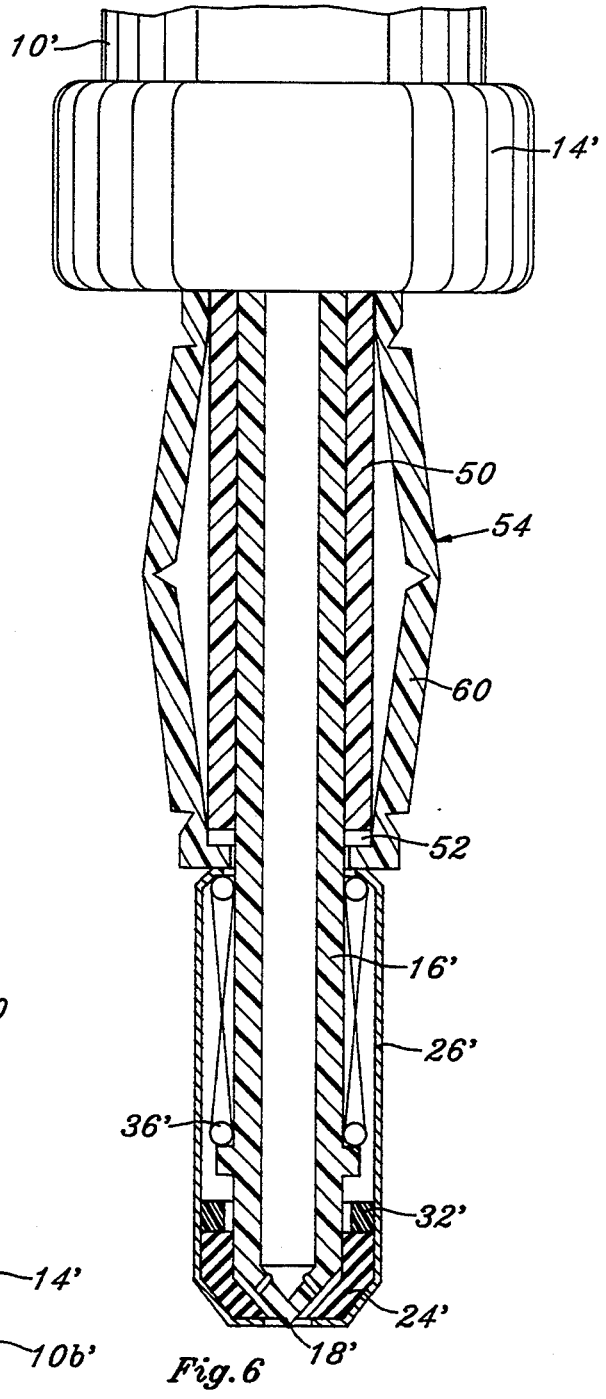
FIG. 6 is comparable to FIG. 4 but showing the parts in dispensing attitude.

As a result of this structure, when the toggle cage is squeezed with thumb and forefinger centrally of the bars, the bars flatten inward (FIG. 6) farther spacing the annular members 56, 58 apart. The upper annular member (FIG. 5) engages the adjacent end of the shell 26' and drives it downwardly (FIG. 6) away from the body 12' to move the gasket 24' away from the tip 18', opening the passage 20'. When the squeeze on the toggle cage is released, the natural resilience of the molded parts causes the bars to reassume the attitude of FIG. 5 wherein the spring 36' drives the shell toward the body 12', seating the gasket 24' on the tip 18' (FIG. 5). Clearly, the structure of the shell 26' and its contents and the stem 16' give the same benefits of the invention as discussed earlier in connection with the preferred embodiment.

Figure 7:
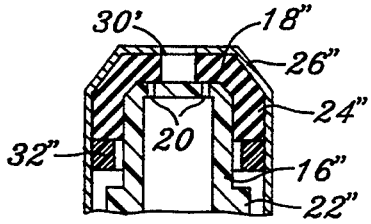
FIG. 7 is a view comparable to the upper portion of FIG. 1 but showing a further modified form of the invention.

In the FIG. 7 modified form of stem 16'' end portion, the end 18'' is flat rather than tapered and features passages 20'' offset from the center of the end. The gasket 24'' is complementary in shape and seats on the flat end, shutting off the passages. While the FIG. 7 version is not the preferred form of the invention, some of the benefits of the invention do attach.

Serving as a propellant for the liquid in the bottle 10, 10' may be a compressed gas in the head space, a soluble gas, a liquified gas, a piston or a bag in the container pressurized in the space between the bag and the container wall. All of these expedients are well known in the art. Because of the nature of the product, it is not normally necessary to use high pressure as a propellant, a somewhat more moderate pressure, for instance, seven pounds per square inch, being sufficient.

It is clear that my invention affords an advantage heretofore unattainable, namely, a reliable, simple dispensing container for sterile liquids. As a long-needed advantage to this structure, it is finally possible to store and dispense sterile liquids without the need for bacteria-killing chemicals. The importance of this advantage cannot be overstressed.

The invention is not limited to the use described or the embodiments shown but may be instead defined by the scope of the following claim language, expanded by an extension of the right to exclude as is appropriate under the doctrine of equivalents.

What is claimed is:

1. A dispensing container for sterile liquids comprising a. a bottle under pressure containing the sterile fluid, b. a slender elongate tubular discharge stem connected to the bottle, the stem having a remote delivery end and an annular outward rib spaced back along the stem from the delivery end, the delivery end having at least one discharge passage therein, c. an annular bacteria-displacing gasket having a valving surface complementing the shape of the delivery end of the stem and normally seated on the delivery end closing the passage, d. a slender elongate rigid tubular shell of uniform diameter along its length circumposing the stem and having a first end surrounding and fixedly carrying the gasket, the first end of the shell presenting a central discharge opening, the other end of the shell spaced back from the first end and being formed with an inward annular flange, the flange being disposed on the opposite side of the rib from the gasket, e. a spring under compression inside the shell and surrounding the stem and forcefully engaging between the flange and the outward annular rib on the stem and biasing the shell toward the bottle, the spring being of sufficient strength to hold the gasket in sealing position on the delivery end of the stem despite the force to raise it exerted by the pressure in the bottle whereby manual movement of the shell away from the bottle raises the gasket from the delivery end and permits sterile liquid to from the bottle through the stem and out the passage and through the discharge opening in the shell, and movement of the shell by the spring back toward the bottle seats the valving surface of the complementary-shaped gasket on the delivery end to thus prevent build-up of bacteria and migration of bacteria from outside the passage to inside the stem.

2. A dispensing container as claimed in claim 1 including lever means working between the shell and the bottle, the lever means being manually operable to move the shell away from the container to unseat the gasket.

3. A dispensing container as claimed in claim 2 wherein the lever means includes a toggle linkage.

4. A dispensing container as claimed in claim 1 wherein the delivery end of the stem and the complementary-shaped gasket are both tapered.

5. A dispensing container as claimed in claim 4 wherein a hole through the stem comprises a first part of the passage and the stem and gasket are shaped to define between them a helical channel comprising a second part of the passage whereby when the gasket is unseated, a swirl is imparted to the liquid.

6. A dispensing container as claimed in claim 5 wherein the helical channel is formed entirely on the stem.

7. A dispensing container as claimed in claim 5 wherein the helical channel is formed entirely on the gasket.

8. A dispensing container as claimed in claim 4 wherein the annular gasket is formed remote from its opening with an integral outward retaining projection and the shell is formed with an outward recess receiving the projection.

9. A dispensing container as claimed in claim 8 wherein both the projection and the recess are annular.

* * * * *